US006251022B1

(12) United States Patent
Mailloux et al.

(10) Patent No.: US 6,251,022 B1
(45) Date of Patent: Jun. 26, 2001

(54) EXCAVATOR PLAY SET

(76) Inventors: Ronald J. Mailloux, 12 Ruby Cir., Bradford, MA (US) 01835; Russell J. Mailloux, 555 Mount Vernon St., Lawrence, MA (US) 01843

( * ) Notice: Subject to any disclaimer, the term of this patent is extended or adjusted under 35 U.S.C. 154(b) by 0 days.

(21) Appl. No.: 09/411,987

(22) Filed: Oct. 4, 1999

Related U.S. Application Data

(60) Provisional application No. 60/150,973, filed on Aug. 27, 1999, now abandoned.

(51) Int. Cl.[7] ..... A63G 9/00

(52) U.S. Cl. ..... 472/118; 472/116; 472/125; 482/35

(58) Field of Search ..... 472/116, 117, 472/118, 125, 136, 137; 482/35, 36; 446/424, 425, 426

(56) References Cited

U.S. PATENT DOCUMENTS

| | | | | |
|---|---|---|---|---|
| D. 250,783 | | 1/1979 | Dieter et al. | D34/5 L |
| D. 253,362 | | 11/1979 | Dieter et al. | D21/243 |
| D. 274,450 | | 6/1984 | Gordon | D21/244 |
| 2,812,869 | * | 11/1957 | Nisperly | 446/424 |
| 3,593,866 | * | 7/1971 | Gazdarica | 446/424 |
| 4,084,812 | | 4/1978 | Melrose et al. | 272/85 |
| 4,262,900 | | 4/1981 | Vinson | 272/113 |
| 4,369,965 | | 1/1983 | Ahrens | 272/56.5 R |
| 4,378,216 | * | 3/1983 | Phillips | 434/159 |
| 4,712,968 | * | 12/1987 | Manning | 446/426 X |
| 5,326,328 | | 7/1994 | Robinson | 472/136 |
| 5,496,232 | | 3/1996 | Morris et al. | 482/35 |
| 5,584,743 | * | 12/1996 | Beaulieu | 446/427 |
| 5,697,851 | | 12/1997 | Delgado | 472/116 |
| 5,816,980 | | 10/1998 | Myszka et al. | 482/35 |

* cited by examiner

*Primary Examiner*—Kien T. Nguyen
(74) *Attorney, Agent, or Firm*—Pearson & Pearson, LLP

(57) ABSTRACT

A play set constructed for recreational use, having a structure resembling an excavator backhoe machine comprising tracks, an elevated platform play area, a cab with simulated controls mounted above the tracks, a counterweight attached to the rear of the play area, a main boom extending upward from the front of the play area having monkey bars spaced apart on the bottom side of the main boom and swings hanging from a horizontal portion of the main boom, a slide attached to a side of the elevated platform play area extending outward away from the play set, and a stick attached to an upper end of the main boom extending downward with a bucket attached to the end of the stick, the lower end of the bucket resting on the ground. The elevated platform play area includes an opening in the floor for entrance to the play area from beneath the play set. The structure may be made of wood, plastic, metal or combinations thereof.

38 Claims, 10 Drawing Sheets

EXCAVATOR PLAY SET

This is a regular patent application claiming priority of provisional patent application Ser. No. 60/150,973, filed Aug. 27, 1999, now abandoned.

BACKGROUND OF THE INVENTION

1. Field of the Invention

This invention relates generally to playground recreational equipment and in particular to a play set having the structure of an excavator type backhoe machine including support tracks, cab, main boom, stick, bucket with toy box, counterweight, elevated platform play area, monkey bars under the boom, swings and a slide.

2. Description of Related Art

Playground equipment in the prior art has taken many forms and shapes such as play houses, tree houses, spaceships, gum ball machines and many other structures. Such structures have been made of popular materials such as wood, plastic and metal. Children are known to be attracted to construction equipment particularly toy dump trucks, tractors with plows and jeeps. A safe, reliable, sturdy structure having the appearance of an excavating machine has not been available for children's recreation that includes a play area, swings, monkey bars, slide, ladder and simulated machine controls.

In U.S. Pat. No. Des. 250,783, issued Jan. 9, 1979 to Dieter et al., assigned to Creative Playgrounds Corporation, a playground structure is shown having a slide at one end of a raised walkway with a ladder extending from this end and at the other end of the walkway a second ladder for climbing to an intermediate height platform before climbing up to the walkway. A third ladder extends from a lower platform adjacent to the intermediate height platform. An auto tire is suspended horizontally from the center of the raised walkway.

In U.S. Pat. No. Des. 253,362, issued Nov. 6, 1979 to Dieter et al., and assigned to Creative Playgrounds Corporation, a playground structure is shown comprising a rope ladder, a swing, two platforms at different heights, the upper level platform having a two sided pitched roof, stairs attached to the lower level platform and a slide extending from the lower level platform.

In U.S. Pat. No. 4,262,900, issued Apr. 21, 1981, to James D. Vinson, this patent discloses a playground set comprising an elevated house, called a treehouse in combination with at least one of the following additional items: one or more swings suspended from a slide extending down from the treehouse, gymnastic bars, a see-saw, parallel bars, backboard for playing basketball, and a fireman's pole.

In U.S. Pat. No. 4,369,965, issued Jan. 25, 1983 to Paul W. Ahrens, and assigned to Miracle Recreation Equipment Company, a playground climber is shown having a slide or extending from one side of an upper portion. FIG. 1 and FIG. 7 show two embodiments. In FIG. 1 a pair of end pieces 14 are interconnected by a tube. The end pieces are octagon in shape with an axial opening provided in each end piece which in turn communicates with the passageway in the tube. FIG. 7 shows an A-shaped playground climber having four pairs of end pieces and a slide bed extending from an opening in end piece to the ground.

In U.S. Pat. No. Des. 274,450, issued Jun. 26, 1984, to Richard F. Gordon, and assigned to Sportsplay Creative Enterprises, Inc. an outdoor child's play unit is shown comprising a raised platform with a two sided pitched roof and the platform is reached by a ladder. A slide extends from the platform to the ground. Swings are provided on each side of the platform.

In U.S. Pat. No. 5,326,328, issued Jul. 5, 1994, to S. Eric Robinson, a play structure that is made with a plastic building element is shown which permits a variety of play structures to be assembled. One embodiment resembles a spaceship or lunar lander using two of the building elements, one inverted over the other and bolted together. Another embodiment resembles a gum ball machine. A slide and rope ladder extend down to the ground from doorways cut in the side walls of the lower shell that is made with a plastic building element which permits a variety of play structures to be assembled.

In U.S. Pat. No. 5,496,232, issued Mar. 5, 1996 to Denny W. Morris et al., a modular playground equipment system is shown comprising a platform including a base portion, a floor portion covering the base portion having a plurality of connection means disposed in spaced apart relation around the periphery of the platform and adapted for attachment to one of the playground equipment modules. A plurality of upstanding columns are attached at one end thereof to the base portion and adapted to one end thereof for attachment to at least one of the playground modules such as slides, and stairs. An upstanding structure attaches to each of the columns, and provides leg supports for the platform.

SUMMARY OF THE INVENTION

Accordingly, it is therefore an object of this invention to provide a play set having the structure of an excavator backhoe.

It is another object of this invention to provide a safe elevated play area having walls surrounding the play area and being within the play set.

It is a further object of this invention to provide an excavator play set for children's recreation comprising swings, ladder, monkey bars, slide, toy storage, and an operator's cab with simulated controls.

These and other objects are further accomplished by a play set comprising a pair of support tracks position parallel to each other, the tracks being interconnected by a plurality of crossmembers, a platform play area mounted on top of the pair of support tracks, a cab positioned adjacent to the play area, a boom extending angularly upward from a front wall of the platform play area, a stick having a first end attached to an outer end of the boom, the stick extending downward, and means attached to a lower end of the stick for supporting the stick and the boom. The play set comprises a swing hanging from the boom. The boom comprises a plurality of dowels mounted on a bottom portion of the boom, each of the dowels spaced a predetermined distance from each other. The cab comprises a plurality of simulated excavator controls. The play set comprises a slide attached to a side of the play set. The supporting means attached to a lower end of the stick comprises a bucket. The bucket comprises a shelf for storage of play items. The play area comprises an opening for access to the play area from under the play set. The play set comprises a counterweight attachment at the rear of the play area, the top surface of the counterweight attachment providing a portion of a catwalk surface for walking around the outside perimeter of the platform play area. Each of the support tracks comprises a track frame assembly having an inner frame and an outer frame and track pieces attached to the outer perimeter of the inner frame and the outer frame. The platform play area comprises a platform comprising a plurality of joists, the joists attached to at least two support beams running parallel to the support tracks, and the support beam being fastened to the plurality of crossmembers. A rear corner of the cab forms a corner of the play area whereby one side wall of a plurality of walls abuts a rear panel of the cab and a front wall of the plurality of walls abuts a side panel of the cab. The boom comprises a pair of simulated hydraulic pistons, a first end of each of the hydraulic pistons attaches to the platform play area and a second end of each of the hydraulic pistons attaches to an upper portion of a first side and a second side of the boom. The boom comprises an angular portion and a horizontal portion. The boom comprises a simulated hydraulic piston structure positioned above the horizontal portion of the boom, a first end of the simulated hydraulic piston connected approximately at the start of the horizontal portion and a second end attached to an upper end of the stick. The stick comprises a simulated hydraulic piston structure positioned along a front surface of the stick, a first end fastened to an upper portion of the stick and a second end fastened to an upper portion of the supporting means.

The objects are further accomplished by a play set comprising a pair of support tracks positioned parallel to each other, the tracks being interconnected by a plurality of crossmembers, a platform play area mounted on top of the pair of support tracks, the play area being surrounded by a plurality of walls, a cab positioned in a corner of the play area having a corner abutting a front wall and a side wall of the play area, the cab comprises a plurality of simulated excavator controls, a boom extending from one of the plurality of walls of the platform play area, the boom having an angular portion and a horizontal portion and a swing hanging from the horizontal portion of the boom, a plurality of dowels mounted on the bottom of the boom, each of the dowels spaced a predetermined distance from each other, a stick having a first end attached to the horizontal portion of the boom, the stick extending downward, a bucket attached to a lower end of the stick for supporting the stick and the boom, and a counterweight component attached to the rear of the play set, the top surface of the counterweight attachment providing a portion of a catwalk surface for walking around the outside perimeter of the platform play area. The play set comprises a slide attached to a side wall of the play area platform. The play area comprises a deck opening for access to the play area from under the play set. Each of the support tracks comprises a track frame assembly having an inner frame and an outer frame and track pieces attached to the outer perimeter of the inner frame and the outer frame. The platform play area comprises a platform comprising a plurality of joists, the joists attached to at least two support beams running parallel to the support tracks, and the support beams being fastened to the plurality of crossmembers. The boom comprises a pair of simulated hydraulic pistons, a first end of each of the simulated hydraulic pistons attaches to the platform play area and a second end of each of the hydraulic pistons attaches to an upper portion of a first and second side of the boom. The boom comprises a simulated hydraulic piston structure positioned above the horizontal portion of the boom, a first end connected approximately at the start of the horizontal portion and a second end attached to an upper end of the stick. The stick comprises a simulated hydraulic piston structure positioned along a front surface of the stick, a first end fastened to an upper portion of the stick and a second end fastened to an upper portion of the supporting means.

The objects are further accomplished by a method of constructing a play set comprising the steps of providing a pair of support tracks positioned parallel to each other, interconnecting the support tracks with a plurality of crossmembers, mounting a platform play area on top of the pair of support tracks, surrounding the play area with a plurality of walls, placing a cab on a portion of the platform play area, extending a boom from a front panel of the platform play area, the boom having an angular portion and a horizontal portion, attaching a stick to an end of the horizontal portion of the boom, the stick extending downward, and supporting the stick and the boom with means attached to a lower end of the stick. The method comprises the step of hanging a swing from the horizontal portion of the boom. The step of providing the boom comprises the step of mounting a plurality of dowels on a bottom portion of the boom, each of the dowels being spaced a predetermined distance from each other. The step of placing a cab on a portion of the play area platform comprises the step of providing a plurality of simulated excavator controls in the cab. The method comprises the step of attaching a slide to a wall of the play set. The step of supporting the stick and the boom comprises the step of providing a bucket attached to a lower end of the stick. The step of providing a bucket comprises the step of providing a shelf within the bucket for storage of play items. The step of enclosing the play area with a plurality of walls comprises the step of providing an opening in a deck portion of the play area for access to the play area from under the play set. The step of placing a cab on a portion of the platform play area comprises the step of providing a plurality of simulated excavator controls in the cab. The method comprises the step of attaching a slide to a wall of the platform play area. The step of surrounding the play area with a plurality of walls comprises the step of abutting two of the walls to sides of the cab. The step of extending a boom from a front panel comprises the step of positioning a pair of simulated hydraulic pistons on each side of the boom, a first end of each of the hydraulic pistons attaches to the platform play area and a second end of each of the hydraulic pistons attaches to an upper portion of each side of the boom. The step of extending a boom from a front wall comprises the step of positioning a simulated hydraulic piston structure above the horizontal portion of the boom, a first end connected approximately at the start of the horizontal portion and a second end attached to an upper end of the stick. The step of attaching a stick to an end of the horizontal portion of the boom comprises the step of positioning a simulated hydraulic piston structure along a front surface of the stick, a first end fastened to an upper portion of the stick and a second end fastened to an upper portion of the supporting means.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
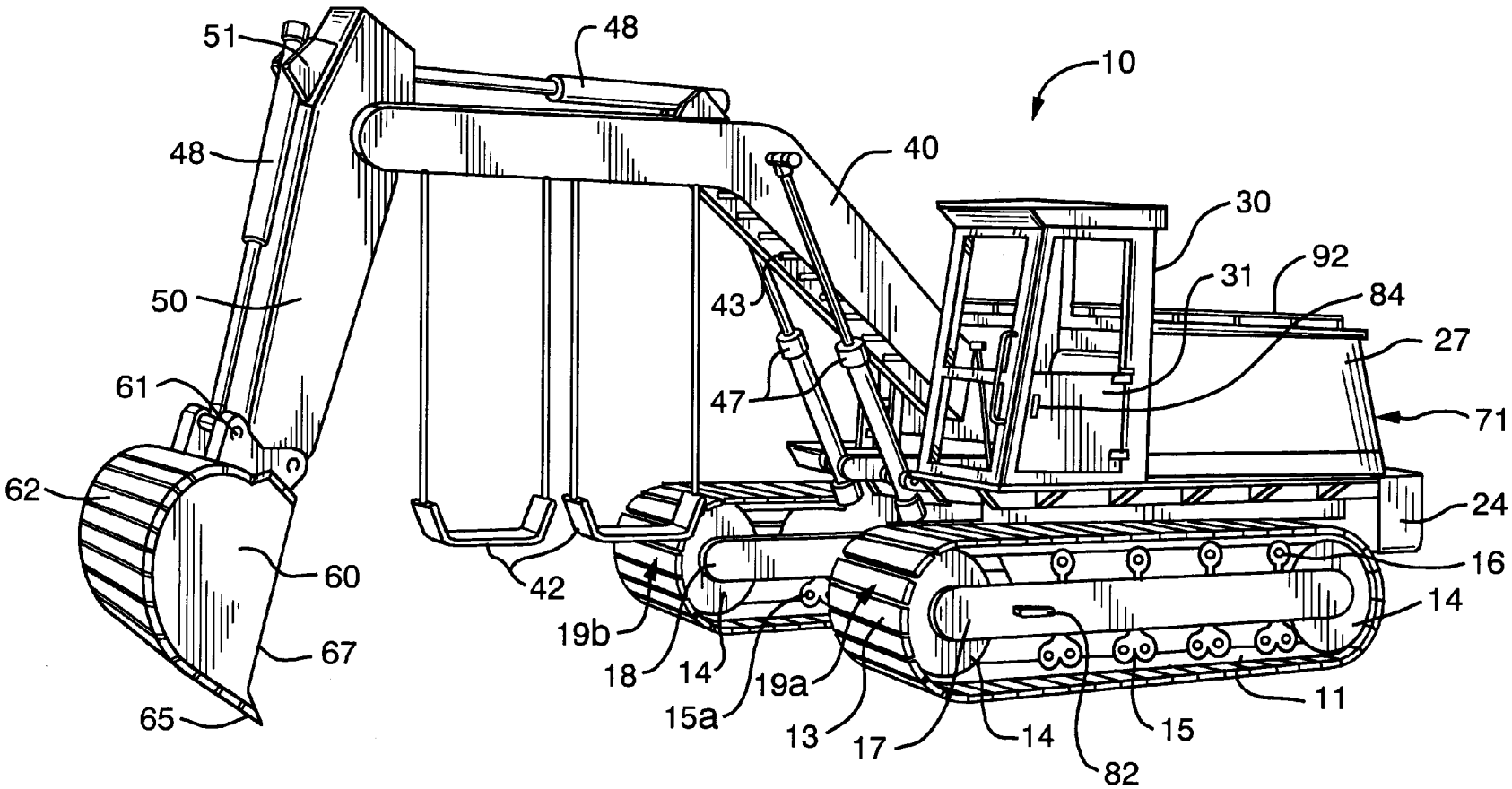
FIG. 1 is a front perspective view of an angle from the cab side of an excavator play set constructed according to a preferred embodiment of the present invention.
Figure 2:
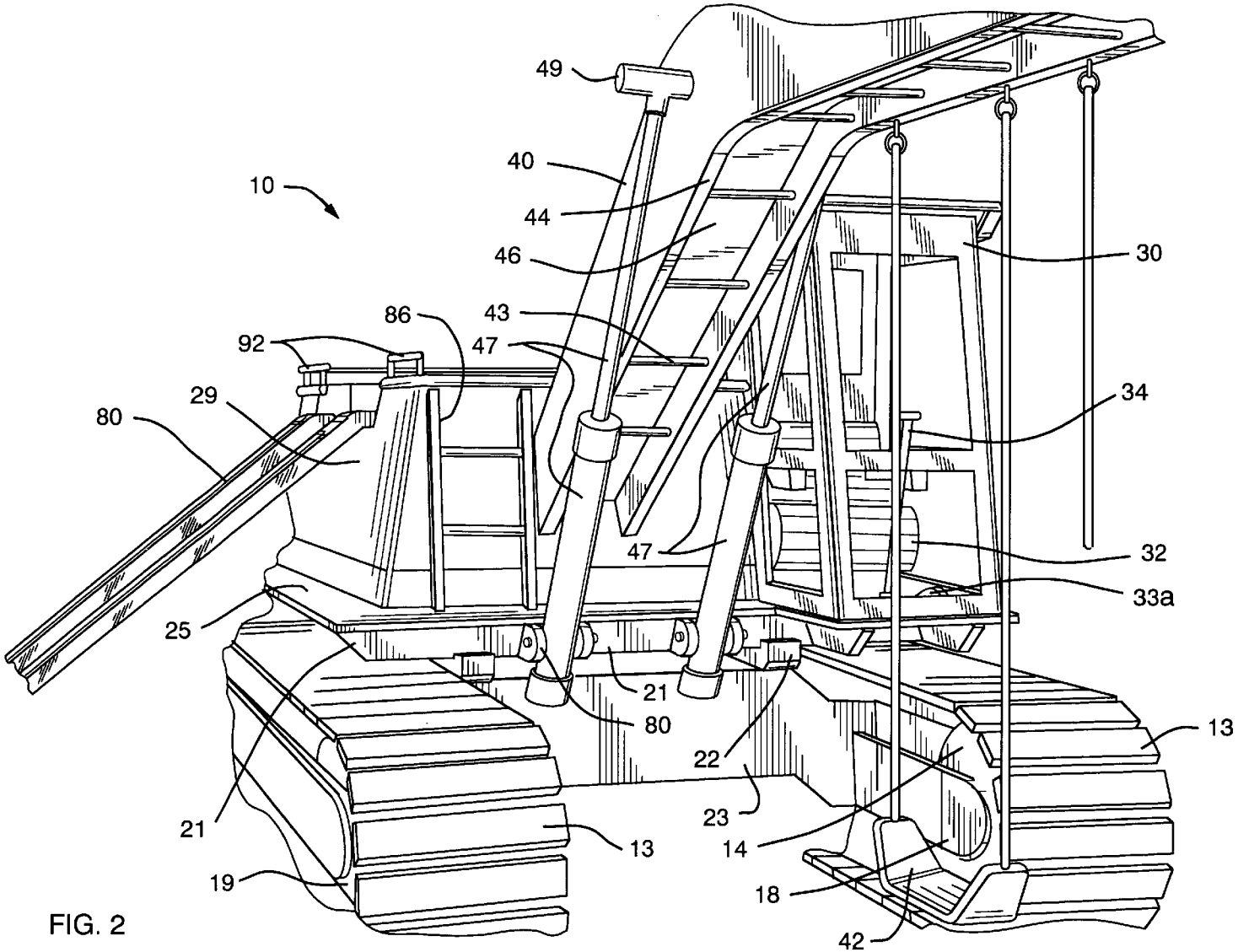
FIG. 2 is a front perspective view of an angle from the ladder side of the excavator play set.
Figure 3:
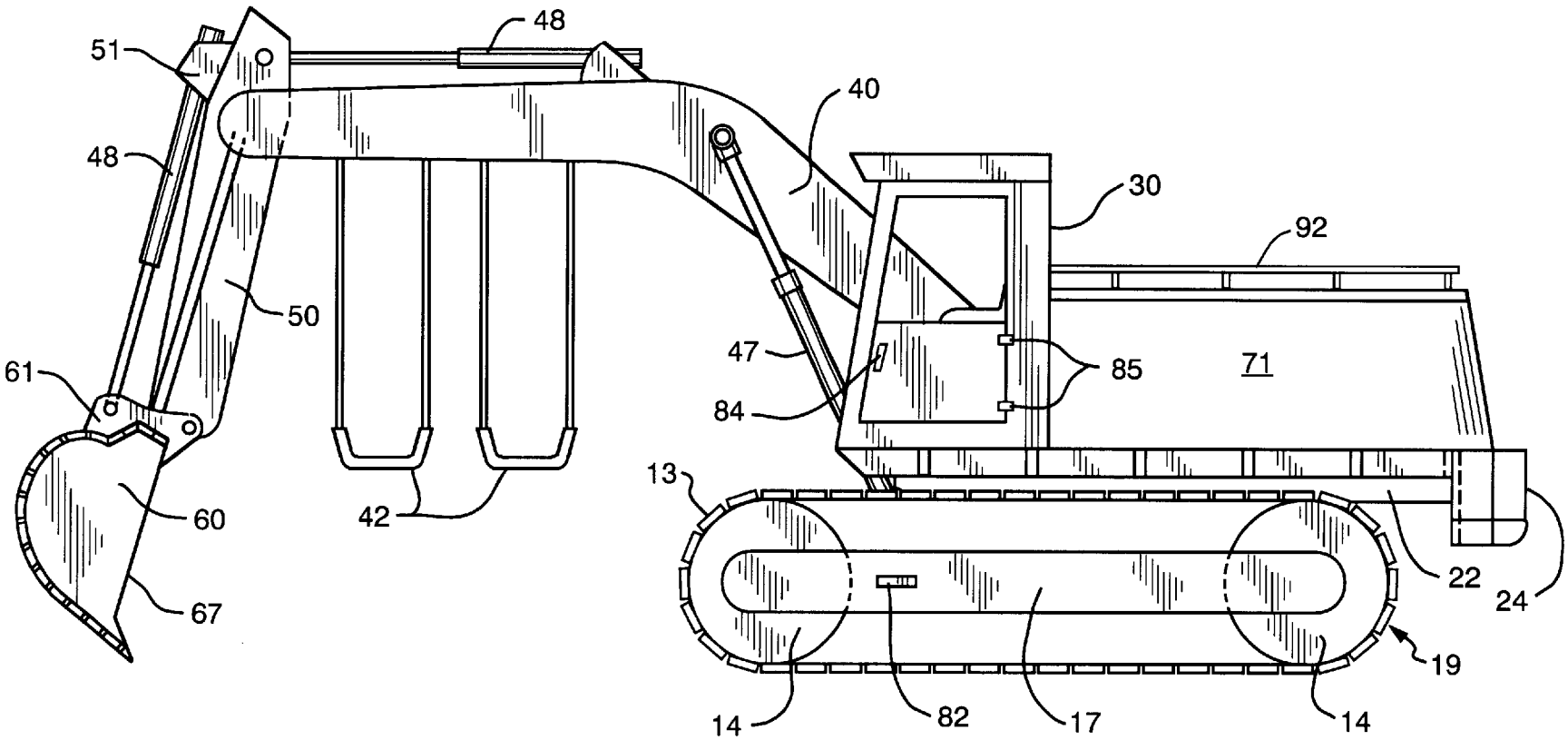
FIG. 3 is a side elevational view of an excavator play set embodiment.

Referring to FIG. 1, FIG. 2, and FIG. 3, FIG. 1 shows a front perspective view of the invention from an angle on the cab side, FIG. 2 is a front perspective view of the excavator play set viewed from an angle on a ladder side, and FIG. 3 shows a side elevational view. The excavator play set 10 is a children's activity play structure made to resemble an excavator type backhoe machine. The majority of the excavator play set 10 is made of wood, but it may also be constructed with plastic or aluminum or the like.

Like a real excavator machine, the excavator play 10 set comprises tracks 19*a*, 19*b*, cab 30, main boom 40, stick 50, bucket 60 and counterweight 24. In addition to its authentic like elements, it comprises simulated controls in the cab 30, a toy box in the bucket 60, monkey bars 43 under the main boom 40, an elevated platform play area 71 behind the cab 30, swings 42 hanging from the main boom 40 and a slide 80 extending from the elevated platform play area 71. The preferred embodiment as shown in FIG. 1 has overall dimensions of 19 feet long, 6.5 feet wide and 8.2 feet high. When located in a play area an additional 6 feet of space on all sides is required for a child's "fall area". The slide is approximately 8 feet long extending from the side of the play area 71.

Referring to FIG. 1 and FIG. 2, the main boom 40 functions as the main support for the two swings 42 attached to the boom 40 with common swiveling swing hardware. There are also dowels or monkey bars 43 located on the underside of the horizontal and sloped sections of the main boom 40. In the present embodiment the monkey bars are 1¼ inch wood dowels that are recessed halfway into the thickness of each main boom side piece 44. The main boom 40 side pieces are constructed of laminated plywood. The main boom 40 is boxed in on the top 45 and bottom 46 with plywood above the dowels 43. One end of the main boom 40 is attached to the front panel 87 where the two ears slip through the slots (not shown) in the front panel 87 and fasten to a boom base 41. A hinge (not shown) may be used where the bottom of the main boom 40 meets the front panel 87 to enable the boom 40 to be easily lowered for transporting the play set 10 and for quick set-up. The other end of the main boom 40 is attached to the stick 50. The boom base 41 is located on the inside of the front panel 87 and attaches to the front panel 87 and the deck boards 25. There is no railing/grab handle on the front panel 87.

Referring to FIGS. 1–3, the main boom 40 comprises simulated hydraulic pistons of type A 47 on each side of the main boom 40, and a type B 48 simulated hydraulic piston is positioned on the front side of the stick 50 and above the horizontal portion of the main boom 40. Both hydraulic piston types 47, 48 are constructed of PVC pipe and capped. One cap is drilled the diameter of an aluminum pipe. The aluminum pipe extends from a PVC T-fitting 49 through the PVC cap into a hydraulic base 47. The hydraulic piston base 47 is attached to the platform joists 21 by brackets 56. A ⅜ inch diameter axle 54 is slid through the brackets 56, hydraulic base 47 (PVC pipe) and aluminum pipe and capped with a pushnut 57. The top of the hydraulics 47 (at the T-fitting 49) is attached with a ⅜ inch diameter axle. This axle passes through the T-fitting 49, main boom 40 and through another T-fitting 49, thereby sandwiching two hydraulics and keeping them parallel with each other. Hydraulic type B 48 is similar in construction to hydraulic type A 47. It is placed along the top of the horizontal portion of the main boom 40, with the hydraulic base 48 attached at one end 52 and at the other end the aluminum pipe end is slipped through a hole in the top extension of the stick 50.

The stick 50 has an upper end attached to the main boom 40 structure and a lower end fastened to the bucket 60. The primary function of the stick 50 in the excavator play set 10 is to provide support and stability to the main boom 40. The stick 50 is laminated plywood construction and it is boxed in on all sides. The stick 50 attaches to the main boom 40 for a rigid connection. The stick 50 may also be attached by a hinge to the main boom 40 to enable the stick 50 to be easily moved for transporting the play set 10 and for quick set-up. A simulated hydraulic piston similar in construction to type B 48 is attached to a bracket 51 and the aluminum pipe end is attached to the bucket flanges 61.

Referring again to FIG. 1, the bucket 60 is utilized as toy box storage 67. The bucket sides 63 are made of plywood and the bucket top is sheathed with individual wood slats 62 making up the outer curved skin. There is a partial plywood panel enclosure 67 in the bucket 60. The bucket 60 and stick 50 are attached at the bucket flanges 61. A bucket base 66 (not shown) is attached to the bucket 60 to secure the bucket 60 to the earth. The bucket base 66 comprises a horizontal beam (typically 4"×4") with a pin on each end driven into the earth. The last slat 62 adjacent to the teeth 65 is bolted to the bucket base 66 for stability and anchoring of the bucket 60. There are teeth 65 located at the bottom edge of the bucket 60 for aesthetic purposes.

Figure 4:
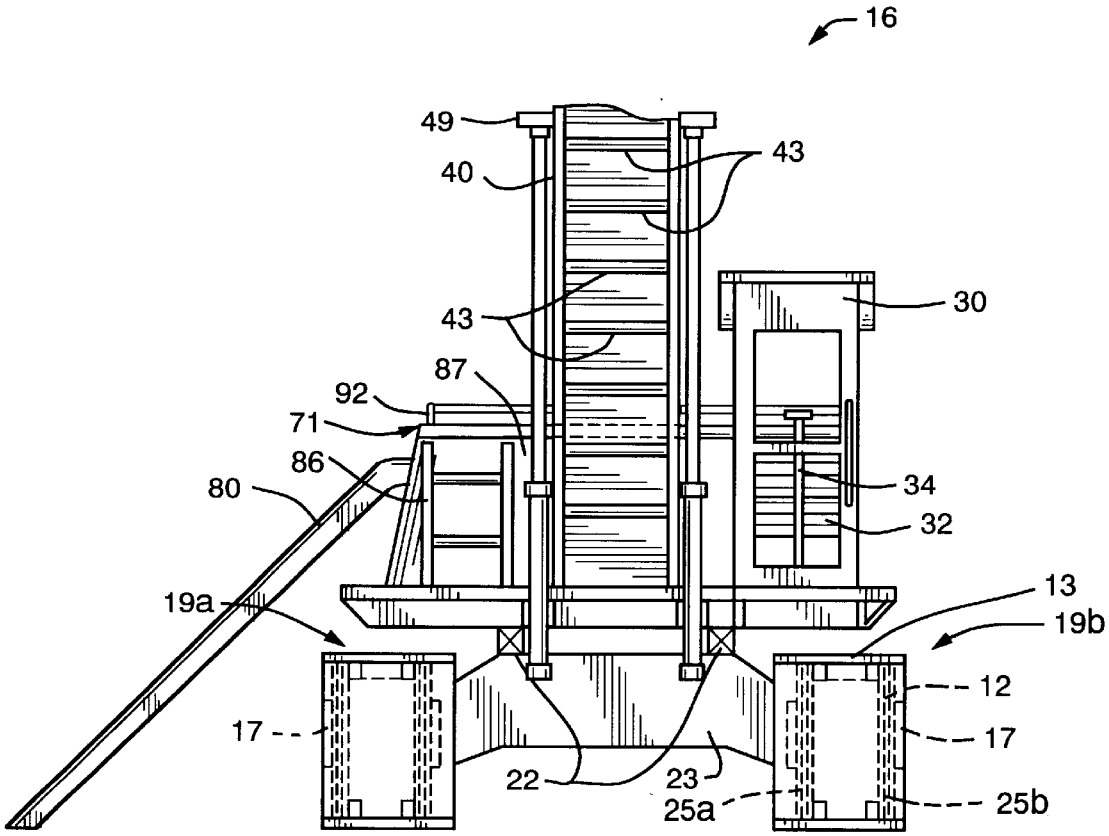
FIG. 4 is a front elevational view of the excavator play set.
Figure 5:
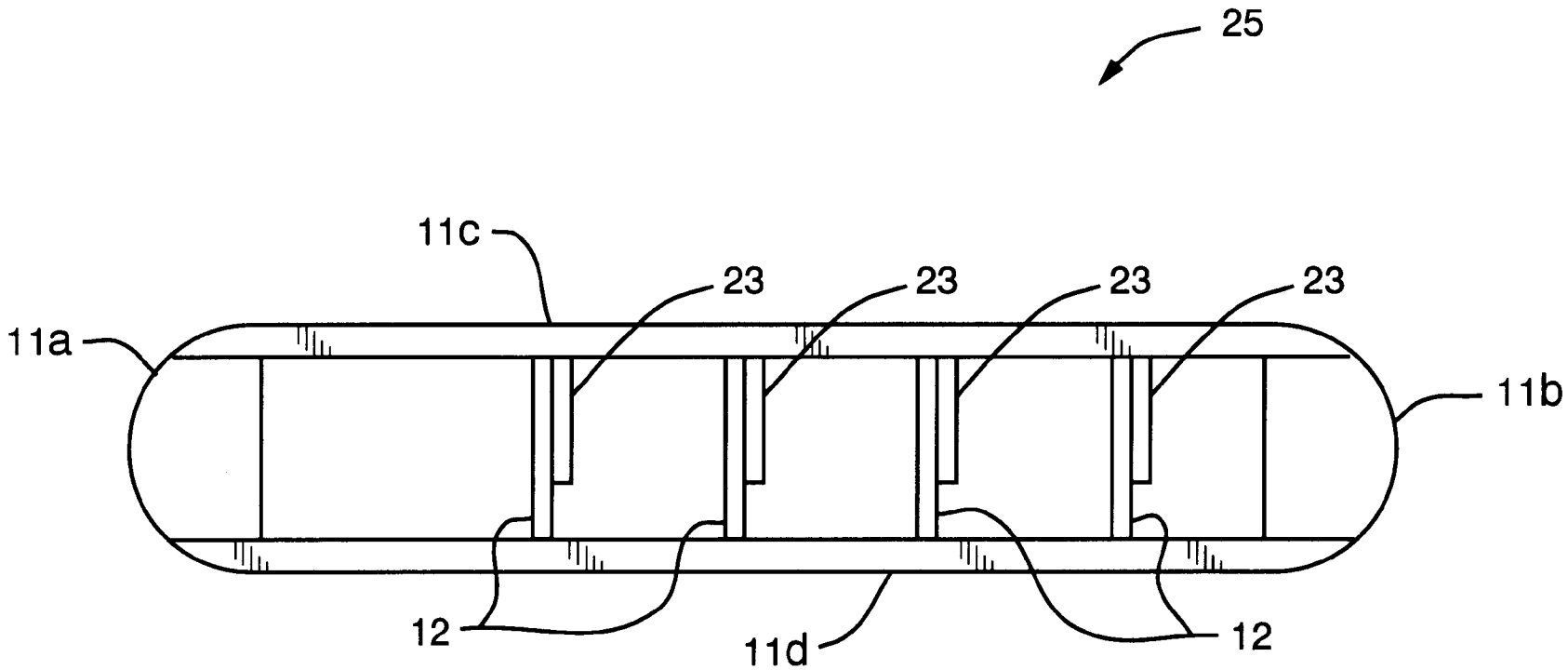
FIG. 5 is a side view of a track frame assembly.

Referring to FIG. 4, a front elevational view is shown of the front portion of the excavator play set 10 showing the cab 30, the bottom portion of the main beam 40 having spaced apart monkey bars 43, two support beams 22 for supporting the elevated platform play area 71, the slide 80 and the two tracks 19*a* and 19*b*. The slide 80 is made from premolded plastic and is approximately 8 feet long. Such a slide is a catalog item available from play set component manufacturers.

Referring now to FIGS. 1–4 and FIG. 5, FIG. 5 shows a side view of a track frame assembly 25 for the excavator play set 10. There are two support tracks 19*a*, 19*b*, one on each side of the play set 10, each of the tracks 19*a*, 19*b* comprises an inner frame 25*a* and an outer frame 25*b* (shown in FIG. 4) having a horizontal top 11*c*, horizontal bottom 11*d*, and radius shaped ends 11*a*, 11*b*. Fastened to the track frame assembly 25 are vertical supports 12. Each vertical support 12 has an end of a cross-member 23 (FIG. 2) fastened to it. Individual track pieces 13 are attached to the outer perimeter of the inner frame 25*a* and outer frame 25*b*. Sprockets 14 are attached at if the radius end areas 11*a*, 11*b* of the inner frame 25*a* and the outer frame 25*b*. FIG. 1 shows bogies 15 and rollers 16 attached to the vertical supports 12 with the roller 16 on top of the bogie 15. There is a single bogie 15*a* located on the inside lower portion of the track frame assembly 25 of track 19*b*, and a similar bogie 15*b* is located on the inside lower portion of track 19*a*. A track beam 17 with a footpeg 82 is attached over the sprocket 14, bogies 15 and rollers 16, and the track beam 17 is fastened into vertical supports 12 and through the sprockets 14 into the radius end areas 11*a*, 11*b* of the track frame assembly 25. The track beam 17 is geographically centered in the track frame assembly 25. A mini-track beam 18 is attached to the front section of the inner track frame 25*a* of tracks 19*a* and 19*b*. The mini-track beam 18 is fastened through the sprocket 14 and the bogie 15 into the vertical support 12. There is a right and left track frame assembly 25 for tracks 19*a* and 19*b*, both of which are similarly constructed. The crossmembers 23 extend between tracks 19*a*, 19*b* with each end being fastened to the vertical supports 12 within each track. The tracks 19*a* and 19*b* provide support for mounting the cab 30 elevated platform play area 71 on top of both tracks 19*a*, 19*b*.

Figure 6:
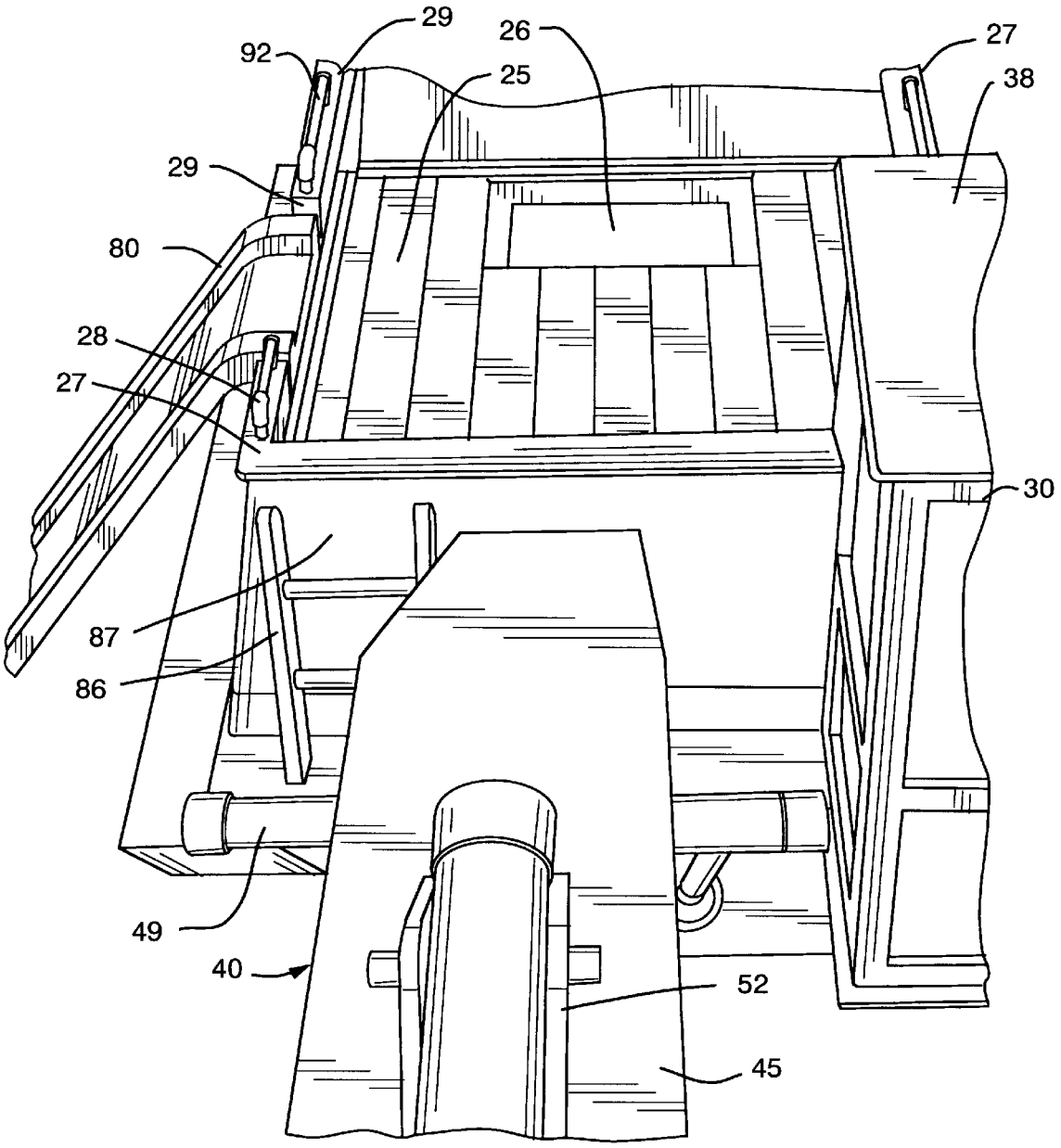
FIG. 6 is a perspective view of inside the elevated platform play area showing an opening for a child to climb into the area.

Referring now to FIG. 6, a perspective view of an open surface, elevated platform play area 71 shows an opening 26 in the deck 25 for a child to climb in and out of the play area 71 from under the play set 10. The play area 71 comprises the deck 25 with a major portion being enclosed by side walls 27, 29, 87, 88 and a rear corner of the cab 30. The wall 29 has a notch for placement of the slide 80 extending out away from the play set 10. A step 55 is provided on the inside of wall 29 between the deck 25 and the slide 80 to facilitate climbing onto the slide 80. A ladder 86 attached to the front wall 87 provides a way to climb up over the wall 87 to get in and out of the elevated platform play area 71. The ladder 86 has two rungs in accordance with the height of the wall 87.

Figure 7:
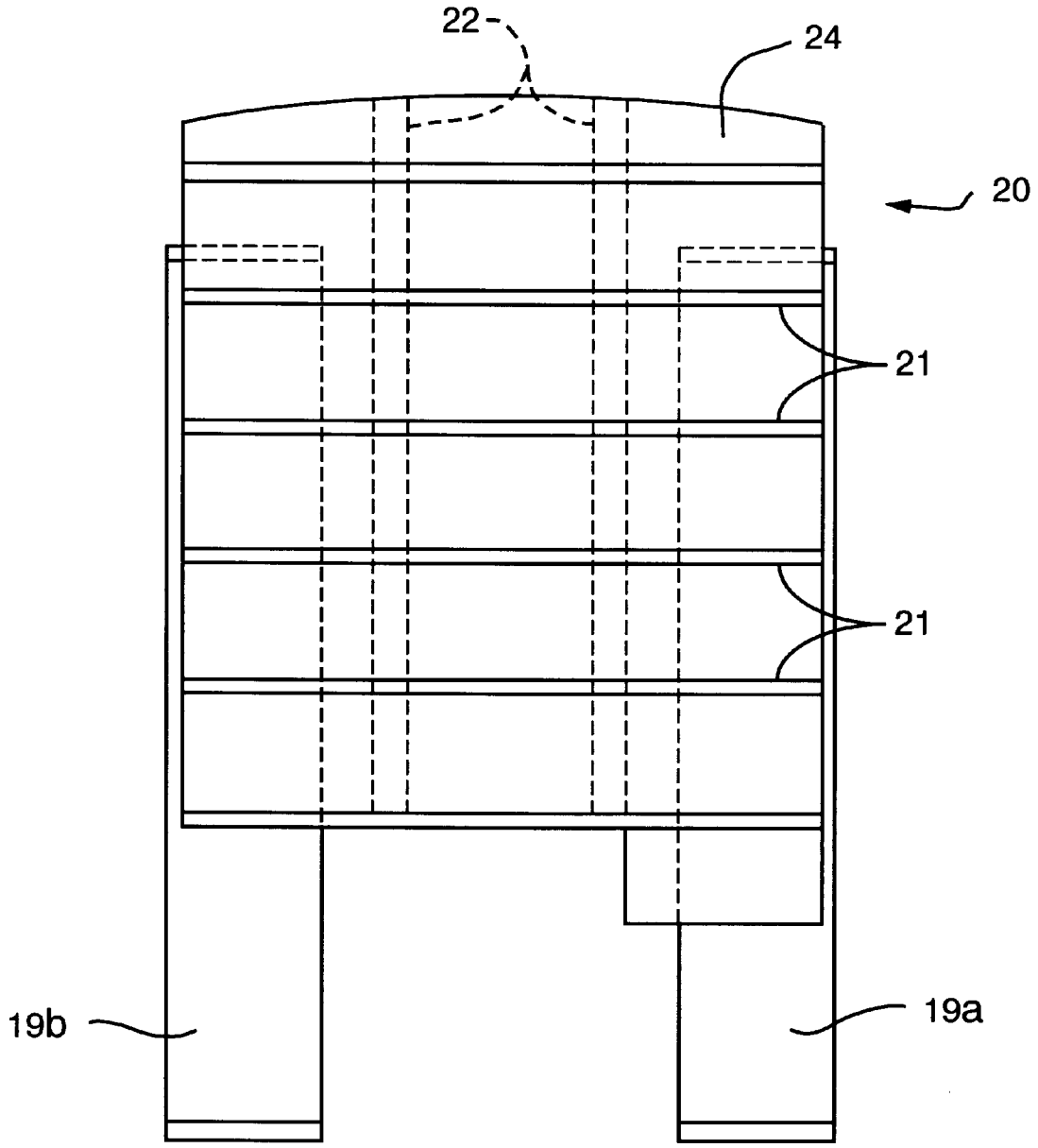
FIG. 7 is a top view of the elevated platform frame positioned on top of the tracks assembly.

Referring to FIG. 7, a top view of a platform 20 for the elevated platform play area 71 is shown positioned on top of tracks 19*a* and 19*b*. The elevated platform 20 is supported by four horizontal crossmembers 23 that are attached perpendicular to both tracks 19*a* and 19*b* and fastened to vertical supports 12 of each track frame assembly 25. Two support beams 22 are attached to the top of the four crossmembers 23 and run to parallel to the tracks 19*a*, 19*b*. The platform joists 21 are attached to the support beams 22. The beams 22 extend beyond the play area surface deck 25 to support the counterweight 24 which attaches to the rear of the platform 20. The deck 25 is implemented with boards spaced to allow water to drain and they attach to the joists 21. The outer boards of deck 25 outside of the walls 27, 29, 87, 88 and counterweight 24 act as a catwalk for perimeter access to the play area 71 and provide an additional play function.

Figure 8:
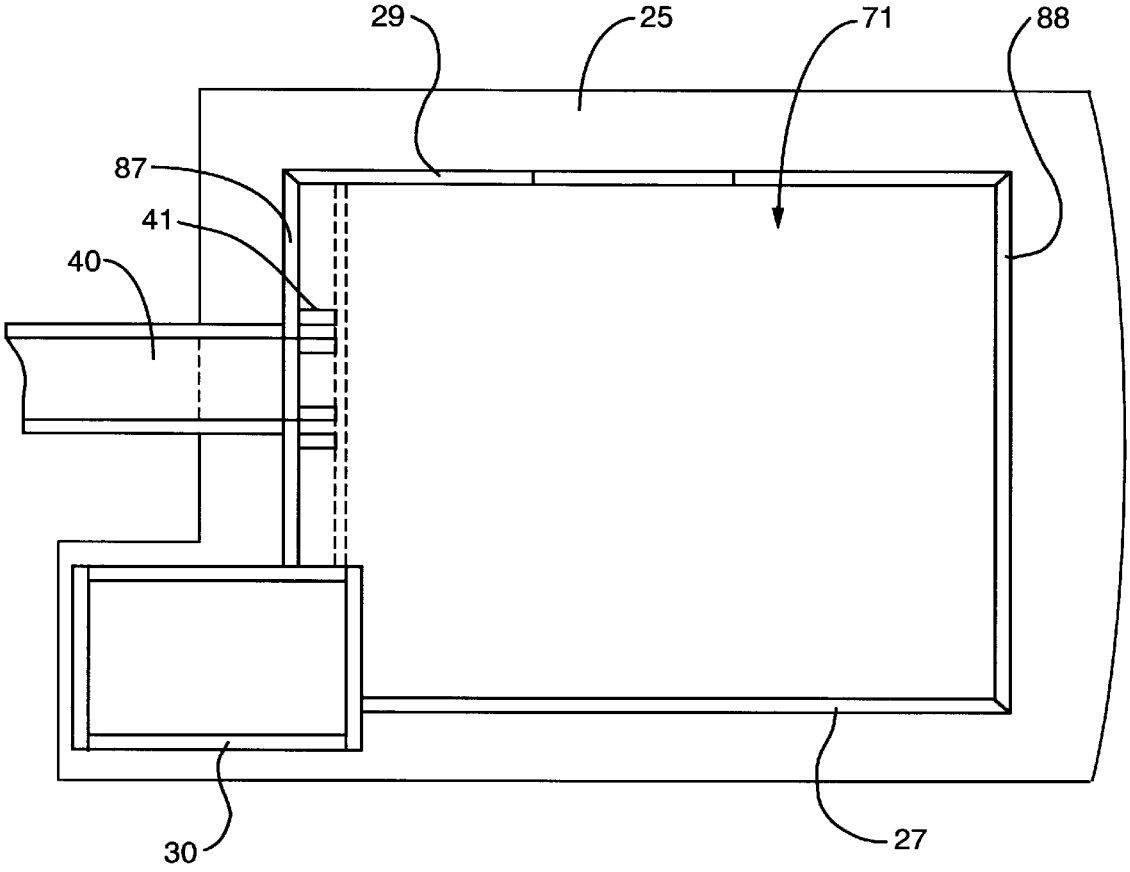
FIG. 8 is a plan view of a cab and the walls of the elevated platform.

Referring to FIG. 8, a plan view is shown of the walls 27, 29, 87, 88 of the play area 71 and the cab 30. The perimeter of the deck 25 outside the walls of the play area 71 along with the top of the counterweight 24 serves as the catwalk. One end of the main boom 40 extends from the front wall 87 upward and away from the play area 71, and it is secured by the boom base 41 inside the front wall 87 on the deck 25.

Figure 9:
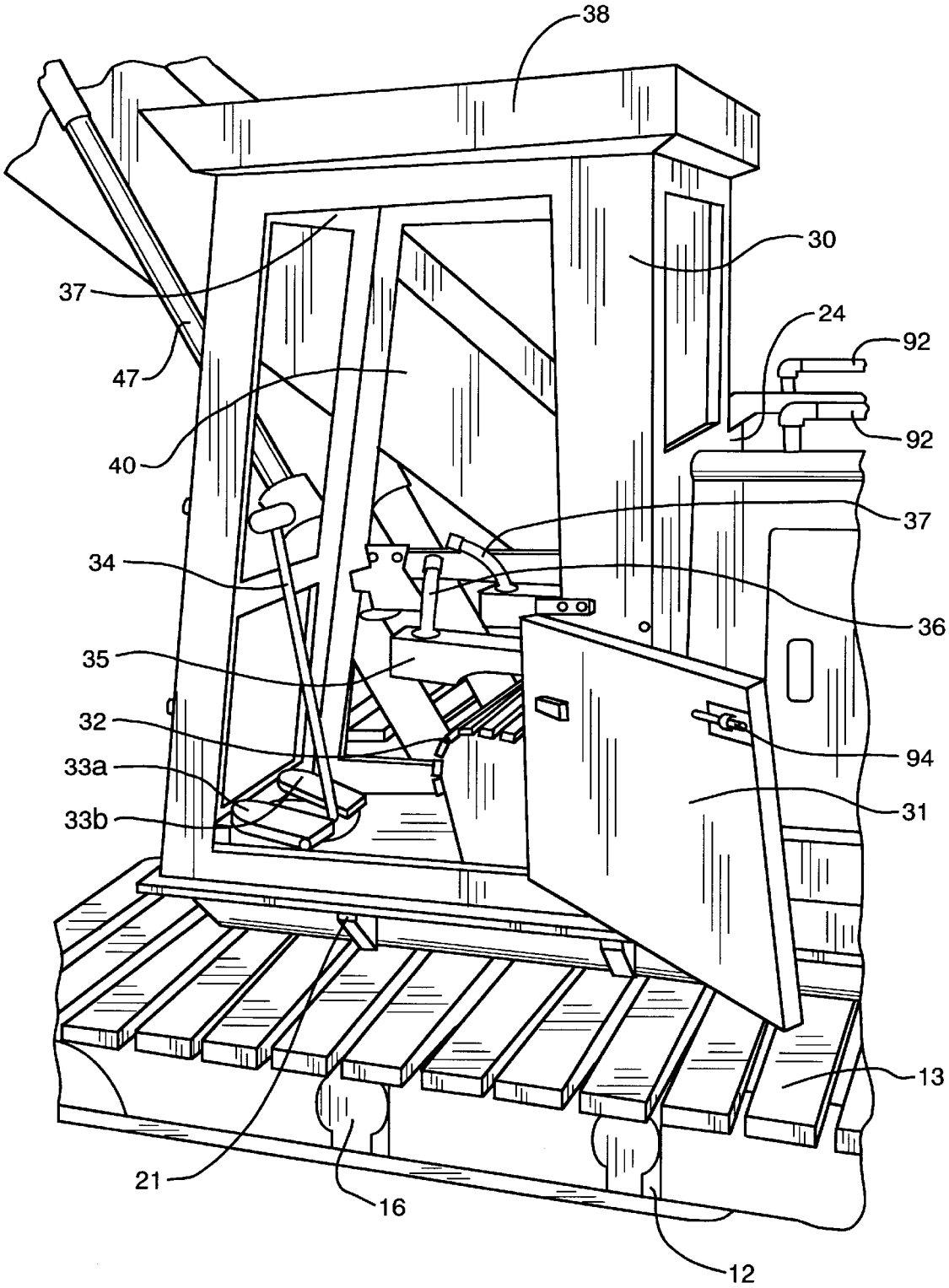
FIG. 9 is a perspective view of the inside of the cab having simulated controls.

Referring to FIG. 9, a perspective view of the inside of the cab 30 is shown with the door 31 open and supported by hinges 85. When the door 31 is closed, it may be locked with a barrel bolt 94. A roof 38 is provided to cover the top of the cab 30. The cab 30 comprises a contoured seat 32 extending the full width of the cab 30. There are simulated controls including two spring loaded floor pedals 33*a*, 33*b*, a single vertical lever 34 that moves front and back, and two arm rests 35 attached along the seat 32 each having a joystick 36, 37.

The joysticks 36, 37 are made of premolded pipe sweep 36 with a foam rubber base inserted into a wood base arm rests 35. A screw fastener is then inserted through a hole of the wood base arm rests 35, foam rubber base and the joysticks 36, 37. The hole through the joysticks 36, 37 is enlarged to provide sloppy movement. This sloppy movement is similar to the side to side and front to back motion of a real excavator joy stick. The two joysticks 36, 37 and the vertical lever 34 are capped with a common foam rubber hand grip. A control panel 37 (not shown) is located inside the cab above the seating area. The control panel 37 comprises a combination of key and toggle switches. The control panel 37 is made of aluminum sheetmetal and fabricated to accept one key cylinder and three toggle switches. The control panel 37 is attached with sheetmetal screws to the top inside corner where the roof 38 meets the front panel of the cab 30.

Figure 10:
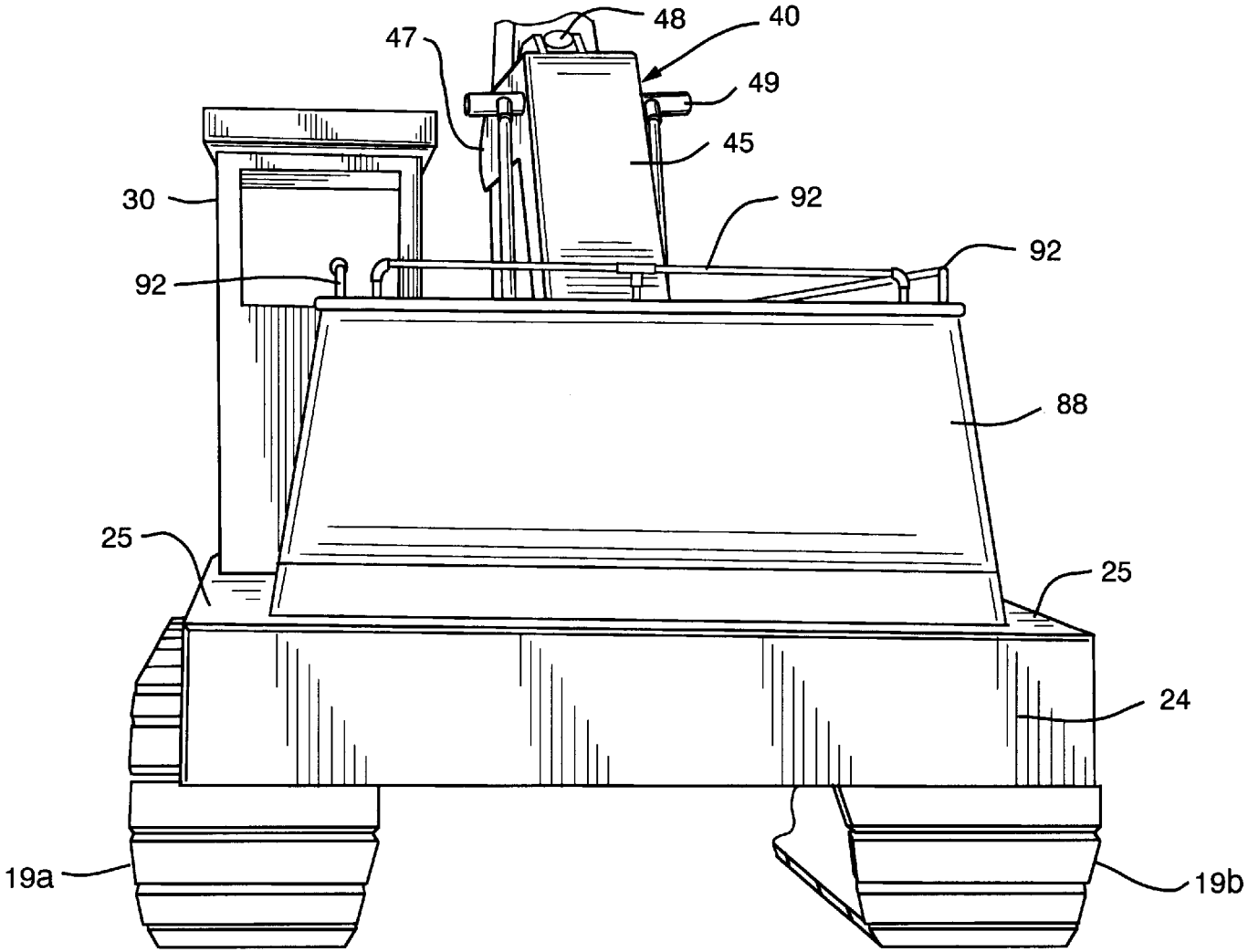
FIG. 10 is a rear elevational view of the excavator play set embodiment.

Referring now to FIG. 6, FIG. 7 and FIG. 10, FIG. 10 shows a rear elevational view of the play set 10 and in particular the counterweight 24. The counterweight 24 is supported by the support beam 22 extension and it is fastened through one of the platform joists 21. The catwalk portion of deck 25 extends around the perimeter of the play area 71 and above the counterweight 24. Also shown in FIG. 10 is a rear wall 88 of the play area 71 having a grab rail 92 mounted on top.

The access scuttle opening 26 is located between the support beams 22 and the counterweight 24. The platform 20 is enclosed by a corner of the cab 30 and walls 27, 29, 87, 88 made of plywood, a rail cap 28 and a railing/grab handles 92. All the side walls 27, 29, 87, 88 are attached with angle brackets to the deck 25 and into each platform joist 21 (where applicable) and at each mitered corner of the rail cap 28. Wall panel 29 is notched to accept the width of the premanufactured plastic slide 80. In the preferred embodiment, each of the wall panels 27, 29, 88 have routered grooves shaped in large squares to simulate door panels. The mini-ladder 86 is provided to access the elevated platform area over the rail cap 28.

Although the materials used in the preferred embodiment comprise wood, plastic and aluminum, one skilled in the art will recognize that many of the parts may be made of either wood, plastic or metal, depending on cost objectives and structural needs of a user. The plywood used in the preferred embodiment such as for the walls 27, 29, 87, 88 is a medium density overlay (MDO) grade of plywood.

This invention has been disclosed in terms of preferred embodiment. It will be apparent that many modifications can be made to the disclosed apparatus without departing from the invention. Therefore, it is the intent of the claims to cover all such variations and modifications as come within the true spirit and scope of this invention.

What is claimed as new and desired to be secured by Letters Patent of the United States is:

1. A play set comprising:

a pair of support tracks position parallel to each other, said tracks being interconnected by a plurality of crossmembers;

a platform play area mounted on top of said pair of support tracks;

a cab positioned adjacent to said play area;

a boom extending angularly upward from a front wall of said platform play area;

a stick having a first end attached to an outer end of said boom, said stick extending downward; and means attached to a lower end of said stick for supporting said stick and said boom.

2. The play set as recited in claim 1 wherein said play set comprises a swing hanging from said boom.

3. The play set as recited in claim 1 wherein said boom comprises a plurality of dowels mounted on a bottom portion of said boom, each of said dowels spaced a predetermined distance from each other.

4. The play set as recited in claim 1 wherein said cab comprises a plurality of simulated excavator controls.

5. The play set as recited in claim 1 wherein said play set comprises a slide attached to a side of said play set.

6. The play set as recited in claim 1 wherein said supporting means attached to a lower end of said stick comprises a bucket.

7. The play set as recited in claim 6 wherein said bucket comprises a shelf for storage of play items.

8. The play set as recited in claim 1 wherein said play area comprises an opening for access to said play area from under said play set.

9. The play set as recited in claim 1 wherein said play set comprises a counterweight attachment at the rear of said play area, said top surface of said counterweight attachment providing a portion of a catwalk surface for walking around the outside perimeter of said platform play area.

10. The play set as recited in claim 1 wherein each of said support tracks comprises a track frame assembly having an inner frame and an outer frame and track pieces attached to the outer perimeter of said inner frame and said outer frame.

11. The play set as recited in claim 1 wherein said platform play area comprises:

a platform comprising a plurality of joists, said joists attached to at least two support beams running parallel to said support tracks; and said support beam being fastened to said plurality of crossmembers.

12. The play set as recited in claim 1 wherein a rear corner of said cab forms a corner of said play area whereby one side wall of a plurality of walls abuts a rear panel of said cab and a front wall of said plurality of walls abuts a side panel of said cab.

13. The play set as recited in claim 1 wherein said boom comprises a pair of simulated hydraulic pistons, a first end of each of said hydraulic pistons attaches to said platform play area and a second end of each of said hydraulic pistons attaches to an upper portion of a first side and a second side of said boom.

14. The play set as recited in claim 1 wherein said boom comprises an angular portion and a horizontal portion.

15. The play set as recited in claim 14 wherein said boom comprises a simulated hydraulic piston structure positioned above said horizontal portion of said boom, a first end of said simulated hydraulic piston connected approximately at the start of said horizontal portion and a second end attached to an upper end of said stick.

16. The play set as recited in claim 1 wherein said stick comprises a simulated hydraulic piston structure positioned along a front surface of said stick, a first end fastened to an upper portion of said stick and a second end fastened to an upper portion of said supporting means.

17. A play set comprising:

a pair of support tracks positioned parallel to each other, said tracks being interconnected by a plurality of crossmembers;

a platform play area mounted on top of said pair of support tracks, said play area being surrounded by a plurality of walls;

a cab positioned in a corner of said play area having a corner abutting a front wall and a side wall of said play area, said cab comprises a plurality of simulated excavator controls;

a boom extending from one of said plurality of walls of said platform play area, said boom having an angular portion and a horizontal portion and a swing hanging from said horizontal portion of said boom;

a plurality of dowels mounted on the bottom of said boom, each of the dowels spaced a predetermined distance from each other;

a stick having a first end attached to said horizontal portion of said boom, said stick extending downward;

a bucket attached to a lower end of said stick for supporting said stick and said boom; and a counterweight component attached to the rear of said play set, said top surface of said counterweight attachment providing a portion of a catwalk surface for walking around the outside perimeter of said platform play area.

18. The play set as recited in claim 17 wherein said play set comprises a slide attached to a side wall of said play area platform.

19. The play set as recited in claim 17 wherein said play area comprises a deck opening for access to said play area from under said play set.

20. The play set as recited in claim 17 wherein each of said support tracks comprises a track frame assembly having an inner frame and an outer frame and track pieces attached to the outer perimeter of said inner frame and said outer frame.

21. The play set as recited in claim 17 wherein said platform play area comprises:

a platform comprising a plurality of joists, said joists attached to at least two support beams running parallel to said support tracks; and said support beams being fastened to said plurality of crossmembers.

22. The play set as recited in claim 17 wherein said boom comprises a pair of simulated hydraulic pistons, a first end of each of said simulated hydraulic pistons attaches to said platform play area and a second end of each of said hydraulic pistons attaches to an upper portion of a first and second side of said boom.

23. The play set as recited in claim 17 wherein said boom comprises a simulated hydraulic piston structure positioned above said horizontal portion of said boom, a first end connected approximately at the start of said horizontal portion and a second end attached to an upper end of said stick.

24. The play set as recited in claim 17 wherein said stick comprises a simulated hydraulic piston structure positioned along a front surface of said stick, a first end fastened to an upper portion of said stick and a second end fastened to an upper portion of said supporting means.

25. A method of constructing a play set comprising the steps of:

providing a pair of support tracks positioned parallel to each other;

interconnecting said support tracks with a plurality of crossmembers;

mounting a platform play area on top of said pair of support tracks;

surrounding said play area with a plurality of walls;

placing a cab on a portion of said platform play area;

extending a boom from a front panel of said platform play area, said boom having an angular portion and a horizontal portion;

attaching a stick to an end of said horizontal portion of said boom, said stick extending downward; and supporting said stick and said boom with means attached to a lower end of said stick.

26. The method as recited in claim 25 wherein said method comprises the step of hanging a swing from said horizontal portion of said boom.

27. The method as recited in claim 25 wherein said step of providing said boom comprises the step of mounting a plurality of dowels on a bottom portion of said boom, each of said dowels being spaced a predetermined distance from each other.

28. The method as recited in claim 25 wherein said step of placing a cab on a portion of said play area platform comprises the step of providing a plurality of simulated excavator controls in said cab.

29. The method as recited in claim 25 wherein said method comprises the step of attaching a slide to a wall of said play set.

30. The method as recited in claim 25 wherein said step of supporting said stick and said boom comprises the step of providing a bucket attached to a lower end of said stick.

31. The method as recited in claim 30 wherein said step of providing a bucket comprises the step of providing a shelf within said bucket for storage of play items.

32. The method as recited in claim 25 wherein said step of enclosing said play area with a plurality of walls comprises the step of providing an opening in a deck portion of said play area for access to said play area from under said play set.

33. The method as recited in claim 25 wherein said step of placing a cab on a portion of said platform play area comprises the step of providing a plurality of simulated excavator controls in said cab.

34. The method as recited in claim 25 wherein said method comprises the step of attaching a slide to a wall of said platform play area.

35. The method as recited in claim 25 wherein said step of surrounding said play area with a plurality of walls comprises the step of abutting two of said walls to sides of said cab.

36. The method as recited in claim 25 wherein said step of extending a boom from a front panel comprises the step of positioning a pair of simulated hydraulic pistons on each side of said boom, a first end of each of said hydraulic pistons attaches to said platform play area and a second end of each of said hydraulic pistons attaches to an upper portion of each side of said boom.

37. The method as recited in claim 25 wherein said step of extending a boom from a front wall comprises the step of positioning a simulated hydraulic piston structure above said horizontal portion of said boom, a first end connected approximately at the start of said horizontal portion and a second end attached to an upper end of said stick.

38. The method as recited in claim 25 wherein said step of attaching a stick to an end of said horizontal portion of said boom comprises the step of positioning a simulated hydraulic piston structure along a front surface of said stick, a first end fastened to an upper portion of said stick and a second end fastened to an upper portion of said supporting means.

* * * * *